US005615480A

United States Patent [19]

Waggoner

[11] Patent Number: 5,615,480

[45] Date of Patent: Apr. 1, 1997

[54] METHODS FOR MAKING SCROLL COMPRESSOR ELEMENT

[75] Inventor: John P. Waggoner, Decatur, Ind.

[73] Assignee: Amcast Industrial Corporation, Dayton, Ohio

[21] Appl. No.: 515,683

[22] Filed: Aug. 16, 1995

[51] Int. Cl.[6] ..... B23P 15/00

[52] U.S. Cl. ..... 29/888.022; 418/55.2

[58] Field of Search ..... 29/888.022; 418/55.2

[56] References Cited

U.S. PATENT DOCUMENTS

| | | | |
|---|---|---|---|
| 4,696,084 | 9/1987 | Huano et al. | 29/888.022 |
| 4,824,345 | 4/1989 | Fukuhara et al. | 29/888.022 |
| 5,103,558 | 4/1992 | Herrick et al. | 29/888.022 |
| 5,122,040 | 6/1992 | Fields | 29/888.022 |
| 5,277,562 | 1/1994 | Fukuhara et al. | 29/888.022 |
| 5,392,512 | 2/1995 | Fann et al. | 29/888.022 |
| 5,478,219 | 12/1995 | Nardon et al. | 29/888.022 |

*Primary Examiner*—Irene Cuda

*Attorney, Agent, or Firm*—Killworth, Gottman, Hagan & Schaeff

[57] ABSTRACT

A high pressure forming process is used to form asymmetric scroll compressor elements wherein a single or multiple piece die is closed at one end by a stop which is formed to correspond to a side of the scroll compressor element opposite to a scroll. A punch sized to fit within the die includes an endface having a scroll shaped cavity. A blank of an appropriate metal is placed in the die against the stop and the punch is then inserted into the die and fully extended to form the blank into a scroll compressor element with a single stroke of the punch. The punch includes vent holes for allowing trapped gases and lubricants to escape as the scroll is formed. The punch may also include an ejector system to facilitate removal of the scroll compressor elements from the punch/die combination. The stop may be defined by a second punch which can be moved into the die for forming parts or can be held stationary during part formation and then moved to facilitate removal of scroll compressor elements from the punch/die combination. It may be desired in some applications to heat the die, punch, stop/punch and blanks.

12 Claims, 2 Drawing Sheets

METHODS FOR MAKING SCROLL COMPRESSOR ELEMENT

BACKGROUND OF THE INVENTION

The present invention relates in general to compressors for air conditioning and refrigeration applications which use a compression element made of a metal disc with an integral scroll on one side and, more particularly, to methods of making such scroll compression elements to a near net shape using a single forming press stroke for each element.

An improved form of air conditioning and refrigeration compressor is being developed wherein rapid rotation of a disc having an integral scroll on one side forces refrigerant outward at high velocity. When the refrigerant's outward movement is impeded by the outer case of the compressor, the energy imparted to the refrigerant is transformed into pressure thus compressing the refrigerant. Such compressors are referred to as scroll compressors reflecting the refrigerant working disc/scroll element.

The scroll compressor elements are currently manufacture by casting aluminum and other appropriate metals with the resulting casting being machined to precise dimensions as required for a given compressor. Unfortunately, such castings have problems including porosity, excessive trim scrap and reduced material properties which make them less than ideal.

A process which is sometimes used as an improvement over casting is known as impact extrusion which is an extrusion process for producing tubular components by striking a metal blank, which has been placed in a die, with a punch moving at high velocity. Since scroll compressor elements are not tubular, they cannot be formed to near a net shape, i.e., the final shape of the a part to be manufactured, using such techniques. A blank could be formed using impact extrusion and then machined to final form. The resulting scroll compressor elements should have properties superior to the cast parts due to a lack of porosity and the orientation of the grain of the metal created by the impact extrusion. The grain orientation should also make such parts superior to fully machined parts.

While impact extrusion followed by machining is an improvement over completely machined scroll compressor elements and machined cast scroll compressor elements, there is a continuing need to further improve production techniques for scroll compressor elements.

SUMMARY OF THE INVENTION

This need is met by the invention of the present application wherein a high pressure forming process which is an improvement over impact extrusion is used to form asymmetric scroll compressor elements. A single or multiple piece die is closed at one end by a stop which is formed to correspond to the side of the scroll compressor element opposite to a scroll. A punch sized to fit within the die includes an endface having a scroll shaped cavity. A blank of an appropriate metal is placed in the die against the stop and the punch is then inserted into the die and fully extended to form the blank into a scroll compressor element with a single stroke of the punch. The punch includes vent holes for allowing trapped gases and lubricants to escape as the scroll is formed. The punch may also include an ejector system to facilitate removal of the scroll compressor elements from the punch/die combination. The stop may be defined by a second punch which can be moved into the die for forming parts or can be held stationary during part formation and then moved to facilitate removal of scroll compressor elements from the punch/die combination. It may be desired in some applications to heat the die, punch, stop/punch and blanks.

In accordance with one aspect of the present invention, a method of forming a scroll compressor element composed of a metal disc with an integral scroll extending from one side of the metal disc comprises the steps of: forming a closed end die having sidewalls substantially corresponding to the maximum dimension of the disc of the scroll compressor element and an endwall corresponding to a defined shape of a side of the metal disc opposite to the one side; forming a punch sized to be received within the closed end die and including an endface having a cavity therein which is shaped to define the scroll; inserting a blank comprised of a predetermined amount of metal substantially corresponding to the scroll compressor element into the closed end die; inserting the punch into the die; extending the punch completely into the die to form the scroll compressor element in a single stroke of the punch; retracting the punch from the die; and, removing the scroll compressor element from the die.

In accordance with another aspect of the present invention, a method of forming a scroll compressor element composed of a metal disc with an integral scroll extending from one side of the metal disc comprises the steps of: forming a die having first and second ends and sidewalls substantially corresponding to the maximum dimension of the disc of the scroll compressor element; forming a first punch sized to be received within the die and including an endface having a cavity therein which is shaped to define the scroll; forming a second punch sized to be received within the die and including an endface having a defined shape of a side of the metal disc opposite to the one side; inserting the second punch into the first end of the die; inserting a blank comprised of a predetermined amount of metal substantially corresponding to the scroll compressor element into the die; inserting the first punch into the second end of the die; extending the first and second punches completely into the die to form the scroll compressor element in a single stroke of the first and second punches; retracting the first and second punches from the die; and, removing the scroll compressor element from the die.

It is, thus, an object of the present invention to provide an improved forming process wherein a single stroke of one or two punches within a die form near net asymmetric scroll compressor elements comprising a disc with an integral scroll on one side.

Other objects and advantages of the invention will be apparent from the following description, the accompanying drawings and the appended claims.

DETAILED DESCRIPTION OF THE INVENTION

Figure 2:
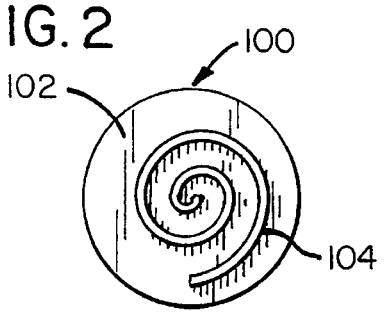
FIG. 2 is a top view of the scroll compressor element of FIG. 1 showing an integral scroll on one side of the disc of the scroll compressor element.
Figure 1:
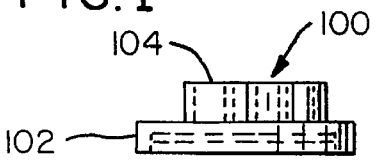
FIG. 1 is an edge view of a scroll compressor element.
Figure 3:
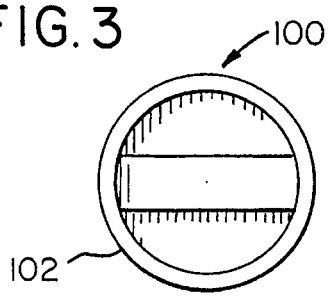
FIG. 3 is a bottom view of the scroll compressor element of FIG. 1 showing the contour of the side of the disc opposite to the side shown in FIG. 2.

The present invention will now be described with reference to the drawings wherein FIGS. 1–3 illustrate a scroll compressor element 100 made, for example, in accordance with the present invention. The scroll compressor element 100 is composed of a metal disc 102 with an integral scroll 104 extending from one side of the metal disc 102. The other side of the metal disc 102 is contoured to provide for mounting the disc 102 to a shaft, lubrication provisions and any other required structural details which are appropriate for use in a corresponding compressor.

Figure 4:
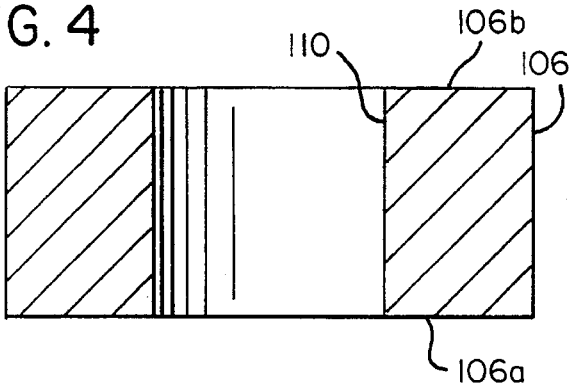
FIG. 4 is a sectional view of a die taken along the section line 4—4 of FIG. 5.
Figure 5:
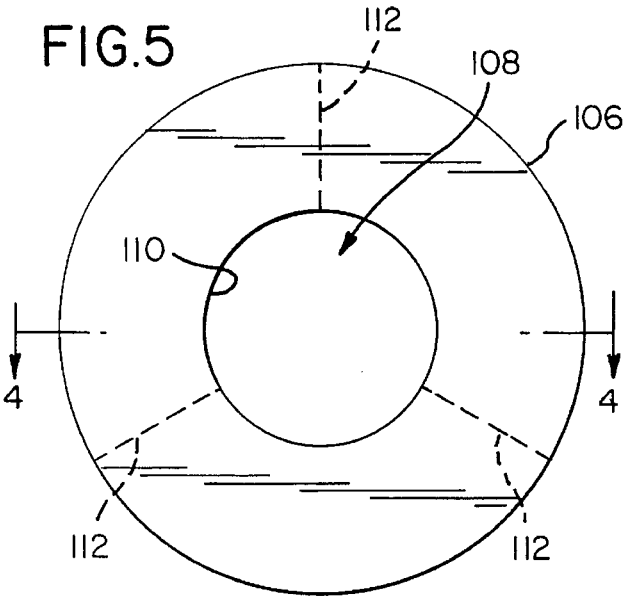
FIG. 5 is a top view of a die for use in the present invention.

FIGS. 4 and 5 show a die 106 having first and second ends 106*a*, 106*b* and a cavity 108 having sidewalls 110 substantially corresponding to the maximum dimension of the disc 102 of the scroll compressor element 100. The die 106 can be a single part or may be split into two or more segments, three segments being suggested by the dotted lines 112 of FIG. 5. If the die 106 is formed of two or more segments, the segments are held together by movable clamps (not shown) and can accommodate undercuts in the part being made which would otherwise make ejection of the part difficult or impossible.

Figure 6:
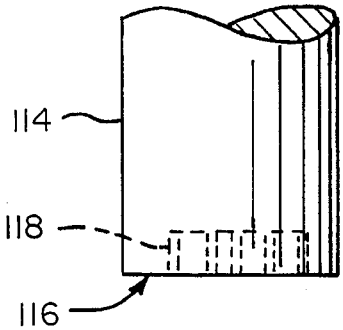
FIG. 6 is a side view of a punch sized to be received within the die of FIGS. 4 and 5 and including an endface having a cavity therein which is shaped to define the scroll shown in FIG. 2.
Figure 9:
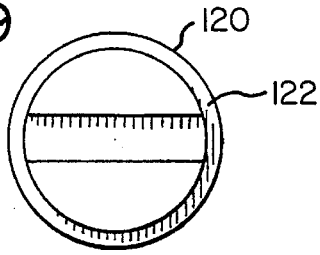
FIG. 9 is an end view of the stop or second punch of FIG. 8.
Figure 7:
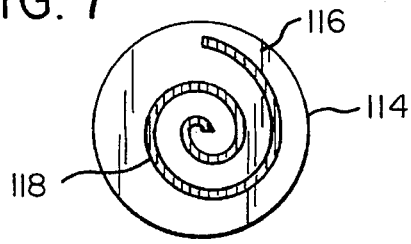
FIG. 7 is an end view of the punch of FIG. 6.
Figure 8:
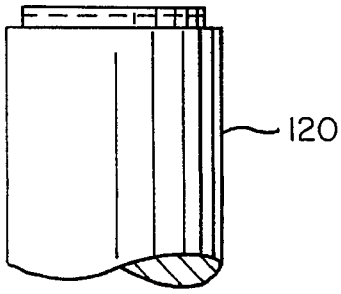
FIG. 8 is a side view of a stop or second punch sized to be received within the die of FIGS. 4 and 5 and including an endface contoured to form the side of the metal disc shown in FIG. 3.

FIGS. 6 and 7 illustrate a side view and end view, respectively, of a first punch 114. The punch 114 is sized to'be received within the cavity 108 of the die 106 and includes an endface 116 having a cavity 118 therein which is shaped to define the scroll 104. FIGS. 8 and 9 illustrate a side view and end view of a second punch 120 sized to be received within the cavity 108 of the die 106. The punch 120 includes an endface 122 having a defined shape of a side of the metal disc 102 opposite to the one side which defines the integral scroll 104.

The second punch 120 may be inserted into the cavity 108 of the die 106 from the first side 106a and maintained in a fixed position during formation of a scroll compressor element such that it forms a stop within the cavity 108 of the die 106. It may be possible, in some applications, to secure the punch 120 within the cavity 108 of the die 106 to form a closed end die or a closed end die can be made in other ways. For example, the endface 122 could be integrally formed as a part of a die where movement of the punch 120 is not required to remove a formed part from the die.

Figure 10:
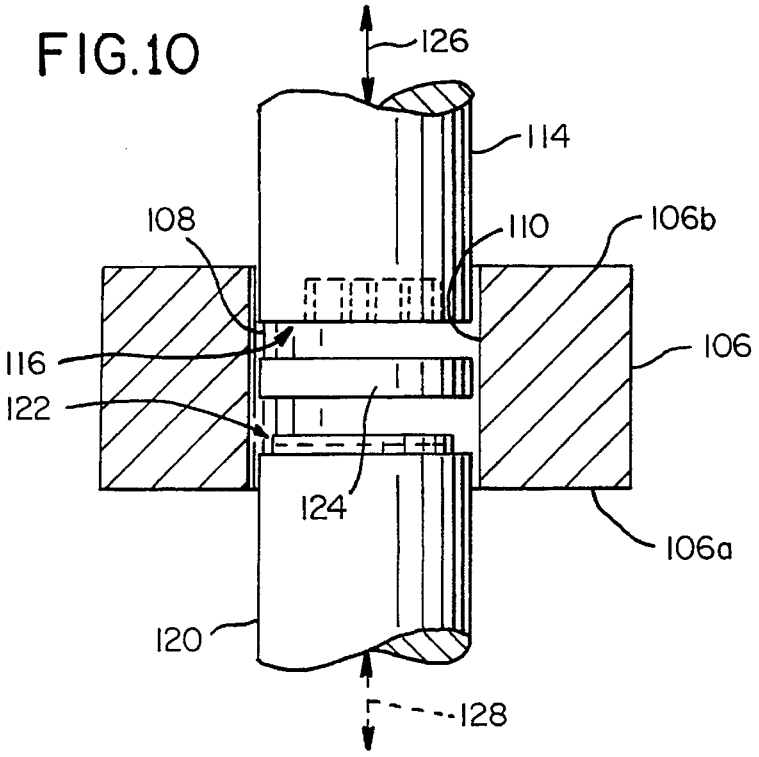
FIG. 10 is a schematic view illustrating formation of a scroll compressor element in accordance with the present invention.

Operation of the tools describe with reference to FIGS. 1–9 in accordance with the method of the present invention will now be described with reference to FIG. 10. The method of forming a scroll compressor element composed of the metal disc 102 with the integral scroll 104 extending from one side comprises initially forming the die 106 to have first and second ends 106*a*, 106*b* and a cavity 108 with sidewalls 110 substantially corresponding to the maximum dimension of the disc 102 of the scroll compressor element 100.

The die 106 can be a closed end die having an integrally formed stop or internal endface. However, as illustrated in FIG. 10, the method comprises forming the second punch 120 sized to be received within the die 106 and including an endface 122 shaped to define the backside of the metal disc 102 as shown in FIG. 3. The punch 120 is inserted into the first end 106a of the die 106 and secured therein or maintained in a fixed position during the forming operation to serve as a stop within the die 106. For this mode of operation, the method further comprises forming the first punch 114 sized to be received within the die 106 which is now a closed end die due to the second punch 120 or other wise. The first punch 114 includes an endface 116 having a cavity therein which is shaped to define the scroll 104.

Next, a blank 124 comprised of a predetermined amount of metal substantially corresponding to the scroll compressor element 100 is inserted into the closed end die. The next step is performed by inserting the punch 114 into the second end 106*b* of the die 106 and extending the punch 114 completely into the die 106 to form the scroll compressor element 100 in a single stroke of the punch 114. The punch 114 is then retracted from the die 106 and a near net scroll compressor element is removed from the die 106 with the punch 120 being moved to facilitate removal if necessary. The near net scroll compressor element is then finish machined as required in a conventional manner. Movement of the punch 114 is indicated by an arrow 126 and movement of the punch 120 is indicated by a dotted line arrow 128 since it may not be moved or even movable as described above.

In a second mode of operation, both the first and second punches 114, 120 are forcibly inserted into the die 106 either in synchronism with one another or asynchronously. In either event, this mode of operation comprises inserting the second punch 120 into the first end 106*a* of the die 106, inserting a blank comprised of a predetermined amount of metal substantially corresponding to the scroll compressor element 100 into the die 106 and inserting the first punch 114 into the second end 106*b* of the die 106. The first and second punches 114, 120 are then completely extended into the die 106 to form the scroll compressor element 100 in a single stroke of the first and second punches 114, 120. The first and second punches 114, 120 are then retracted from the die 106 and the resulting near net scroll compressor element is removed from the die 106. The near net scroll compressor element is then finish machined as required in a conventional manner.

Figure 11:
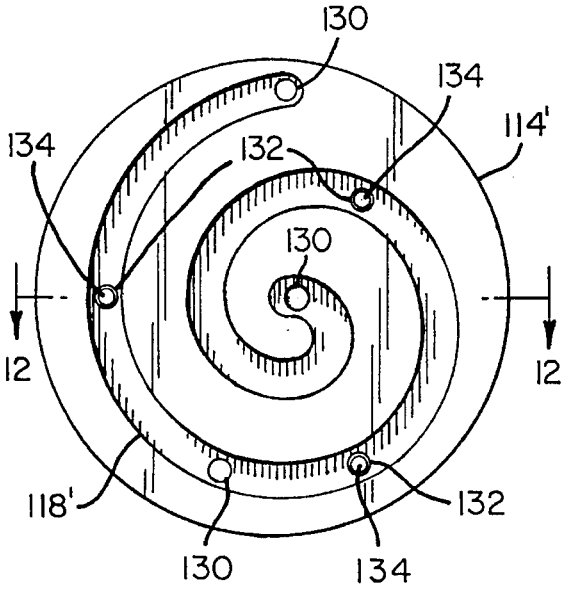
FIG. 11 is a bottom view of a punch illustrating vents and an ejector system of the punch of FIGS. 6 and 7; and, FIG. 12 is a sectional view of the punch of FIG. 11 taken along the section line 12—12.
Figure 12:
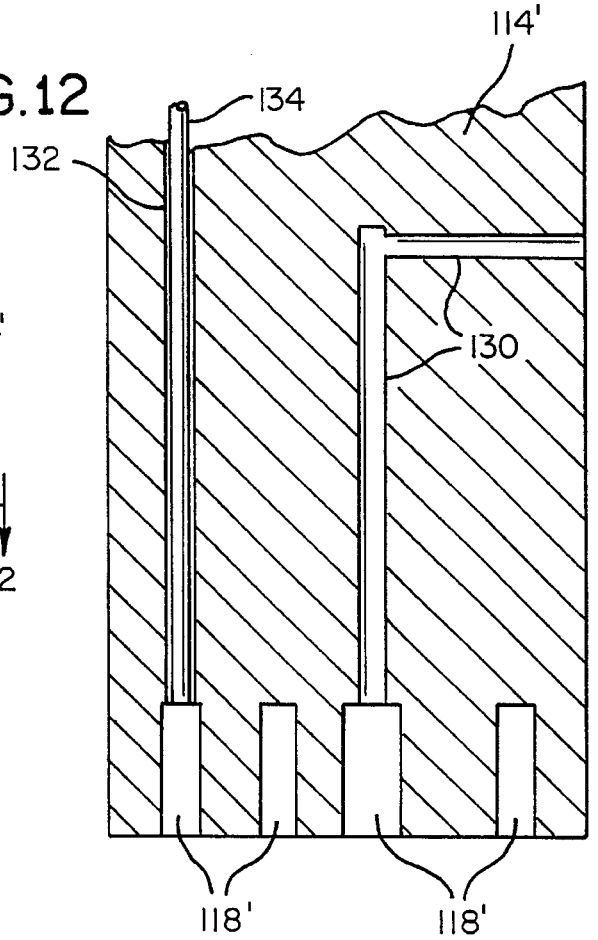

FIGS. 11 and 12 illustrate improvements to the first punch 114 which add vents for trapped gasses and lubricant from the cavity which is shaped to define the scroll 104. As illustrated in FIGS. 11 and 12, a modified first punch 114'includes a cavity 118' which forms the scroll 104 of the scroll compressor element 100. As illustrated, three vents 130 are formed in the punch 114' and three ejectors 132 are also provided in the punch 114'. Operation of the vents 130 is self evident. With regard to the ejectors 132, as the punch 114' is withdrawn from the cavity 108 of the die 106, ejector rods 134 are extended or actuated downward to force the near net scroll compressor element from the punch 114'. The number of vents and ejectors as well as their positions can vary dependent upon the structure of the part being formed.

Having thus described the invention of the present application in detail and by reference to preferred embodiments thereof, it will be apparent that modifications and variations are possible without departing from the scope of the invention defined in the appended claims.

What is claimed is:

1. A method of forming a scroll compressor element composed of a metal disc with an integral scroll extending from one side of said metal disc, said method comprising the steps of:

forming a closed end die defining a cavity having sidewalls substantially corresponding to the maximum dimension of said disc of said scroll compressor element and an endwall corresponding to a defined shape of a side of said metal disc opposite to said one side;

forming a punch sized to be received within said closed end die and including an endface having a cavity therein which is shaped to define said scroll;

inserting a blank comprised of a predetermined amount of metal substantially corresponding to said scroll compressor element into said closed end die;

inserting said punch into said die;

extending said punch completely into said die to form said scroll compressor element in a single stroke of said punch;

retracting said punch from said die; and removing said scroll compressor element from said die.

2. A method of forming a scroll compressor element as claimed in claim 1 wherein the step of forming a closed end die comprises the step of inserting a stop into said die to define said closed end of said die.

3. A method of forming a scroll compressor element as claimed in claim 1 wherein the step of forming a closed end die comprises the step of securing at least two die segments together to define said die.

4. A method of forming a scroll compressor element as claimed in claim 3 wherein the step of forming a closed end die further comprises the step of inserting a stop into said die to define said closed end of said die.

5. A method of forming a scroll compressor element as claimed in claim 4 further comprising the step of using said stop to eject said scroll compressor element from said die.

6. A method of forming a scroll compressor element as claimed in claim 1 wherein the step of forming a punch comprises the step of forming vents into said punch to vent trapped gasses and lubricant from said cavity.

7. A method of forming a scroll compressor element as claimed in claim 6 wherein the step of forming a punch further comprises the step of incorporating an ejector system into said punch to facilitate removal of said scroll compressor element from said closed end die.

8. A method of forming a scroll compressor element as claimed in claim 1 further comprising the step of heating said die, said punch and said blank.

9. A method of forming a scroll compressor element composed of a metal disc with an integral scroll extending from one side of said metal disc, said method comprising the steps of:

forming a die have first and second ends and a cavity with sidewalls subtantially corresponding to the maximum dimension of said disc of said scroll compressor element;

forming a first punch size to be received within said die and including an endface having a cavity therein which is shaped to define said scroll;

forming a second punch sized to be received within said die and including an endface having a defined shape of a side of said metal disc opposite to said one side;

inserting said second punch into said first end of said die;

inserting a blank comprised of a predetermined amount of metal substantially corresponding to said scroll compressor element into said die;

inserting said first punch into said second end of said die;

extending said first and second punches completely into said die to form said scroll compressor element in a single stroke of said first and second punches;

retracting said first and second punches from said die; and removing said scroll compressor element from said die.

10. A method forming a scroll compressor element as claimed in claim 9 wherein the step of forming a first punch comprises the step of forming vents into said first punch to vent trapped gasses and lubricant from cavity.

11. A method of forming a scroll compressor element as claimed in claim 10 wherein the step of forming a first punch further comprises the step of incorporating an ejector system into said first punch to facilitate removal of said scroll compressor element from said die.

12. A method of forming a scroll compressor element as claimed in claim 11 further comprising the step of heating said die, said first and second punches and said blank.

* * * * *